United States Patent [19]

Simpson

[11] Patent Number: 4,762,185

[45] Date of Patent: Aug. 9, 1988

[54] OFF-SHORE DRILLING

[75] Inventor: Brian K. Simpson, Congresbury, Great Britain

[73] Assignee: DRG (UK) Limited, Bristol, England

[21] Appl. No.: 561

[22] Filed: Jan. 2, 1987

[30] Foreign Application Priority Data

Jan. 3, 1986 [GB] United Kingdom ..... 8600053

[51] Int. Cl.[4] ..... E21B 19/20

[52] U.S. Cl. ..... 175/5; 175/8; 414/22

[58] Field of Search ..... 166/358; 175/5, 7, 8, 175/10, 52, 85; 414/22; 211/70.4

[56] References Cited

U.S. PATENT DOCUMENTS

| | | | |
|---|---|---|---|
| 3,650,339 | 3/1972 | Selfe et al. | 175/5 X |
| 3,699,688 | 10/1972 | Estes | 175/9 X |
| 3,961,673 | 6/1976 | Wolters et al. | 175/9 X |
| 4,044,895 | 8/1977 | Adair | 175/5 X |
| 4,251,176 | 2/1981 | Sizei et al. | 175/5 X |
| 4,502,551 | 3/1985 | Rule et al. | 175/8 X |

*Primary Examiner*—Stephen J. Novosad
*Assistant Examiner*—William P. Mender
*Attorney, Agent, or Firm*—Cushman, Darby & Cushman

[57] ABSTRACT

A semi-submersible drill rig structure includes a ring-like enclosure surrounding a central drilling axis. In the structure are magazines holding drill string elements vertically. Lifting means on the structure raise the vertical drill string elements from their magazines and carry them to the drilling axis. A guide ring is displaceable to and from the drilling axis, in synchronism with the lifting means, to restrain the lower end of each raised element against pendulation. The magazines are rotatable about vertical axes to bring the individual elements under the line of movement of the lifting means and guide ring. Well casing elements are similarly restrained by the guide ring as they also are carried in a vertical orientation to the drilling axis. The disposition of the magazines in a structure surrounding the drilling axis provides a relatively calm region through which the drilling operations can be conducted.

14 Claims, 6 Drawing Sheets

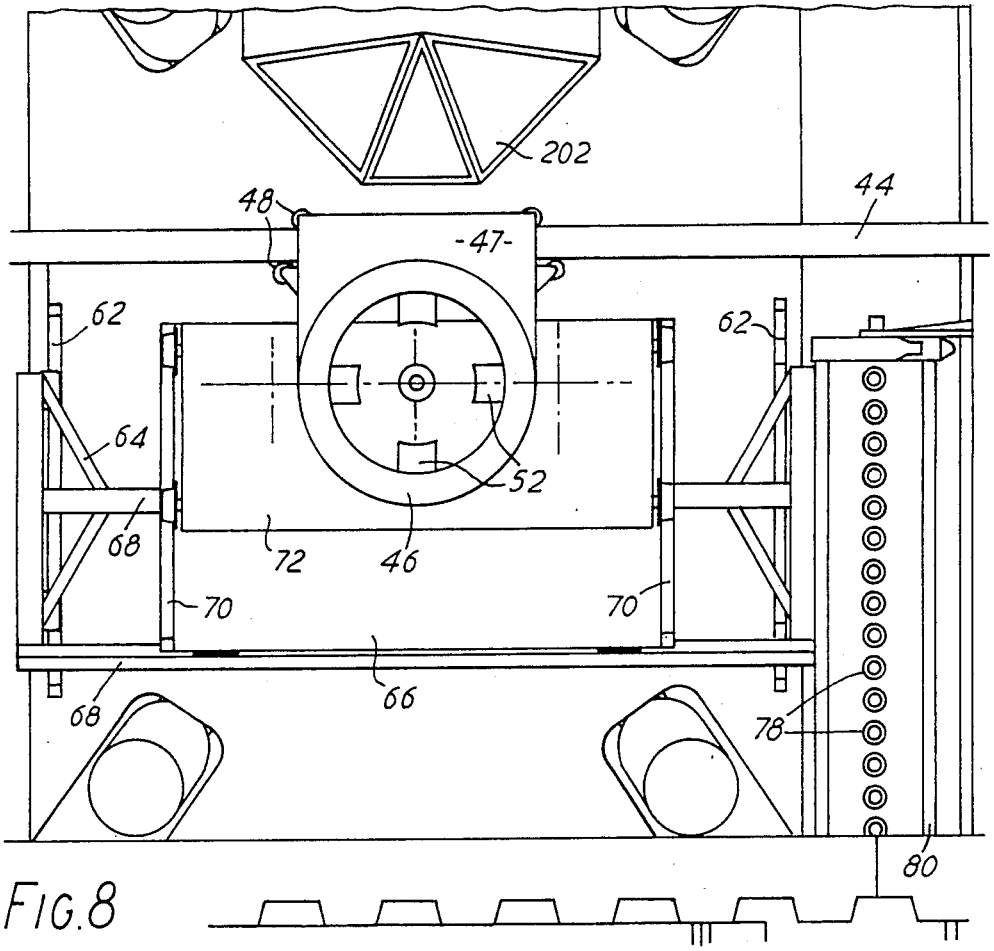
FIG. 8
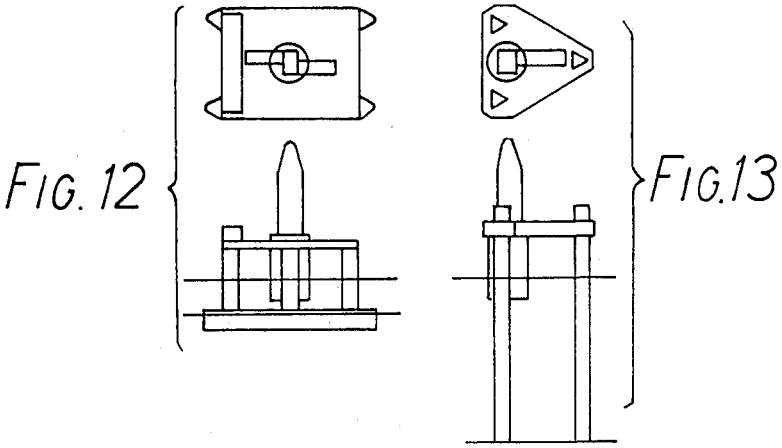
FIG. 12
FIG. 13

OFF-SHORE DRILLING

BACKGROUND OF THE INVENTION

This invention relates to drill rigs, especially for off-shore drilling, and the handling of the equipment used on such rigs.

Off-shore drilling operations have demanding requirements, especially in unsheltered locations, when large and heavy masses must be manipulated, often in adverse weather conditions. Even though techniques have been developed, the safe handling of the equipment in these circumstances is difficult and can often be time-consuming, while there can also be problems in preventing damage to the equipment itself while it is being handled.

It is an object of the present invention to provide means whereby at least some of the problems of handling drilling equipment may be alleviated.

SUMMARY OF THE INVENTION

According to one aspect of the invention, there is provided an apparatus for handling drilling equipment comprising at least one storage space arranged to hold drill string elements with their axes substantially vertical, and means for lifting successive elements from said space in their substantially vertical orientation and moving them laterally to a drilling axis for assembly in series on said axis, guide means being provided for restraining the lifted elements to prevent or limit swinging of an element on said lifting means while it is being moved.

Preferably the guide means comprises a device that is displaceable to and from the drilling axis at such a level above said storage space that when a drill string element is raised by the lifting means to be moved to the drilling axis, its lower end can be engaged by the guide device and said device can be moved in step with the movement of the drill string element on its lifting means as said element is brought to the drilling axis.

In another preferred feature, the drill string elements are held in the storage space in a magazine or turret that is displaceable, conveniently by rotation about a vertical axis, so that by movement of the magazine successive elements can be brought to a zone of action of the guide means to be successively withdrawn from the storage space.

According to another aspect of the invention, there is provided an apparatus for handling off-shore drilling equipment comprising a structure having a ring-like enclosure surrounding and protecting a central open-bottomed well providing a free air/water surface and through which a drilling axis extends, and means for supplying drilling elements and bore-hole casing elements from storage locations in the structure to be assembled on the drilling axis protected by said structure.

The invention will be described in more detail by way of example with reference to the accompanying drawings.

BRIEF OF THE DRAWINGS

FIG. 1 is a central axial section, on the plane C—C in FIG. 3, of apparatus according to the invention constructed as a self-contained unit, FIGS. 2 and 3 are plan sections to different scales in the planes A—A and B—B respectively in FIG. 1, FIG. 4 is a partial plan section on the plane D—D in FIG. 1, FIG. 5 is a detail illustration of the power swivel on its carriage, FIGS. 6 and 7 are views in two directions and to different scales illustrating the handling of bore-hole casings within the apparatus.

FIG. 8 is a detail plan view of a part of FIG. 3 to a larger scale,

FIGS. 12 and 13 are pairs of outline plan and side views of installations incorporating the apparatus of the preceding figures.

DESCRIPTION OF THE PREFERRED EMBODIMENT

The apparatus shown in FIGS. 1–7 comprises a main body 2 serving as a carrier and operating platform for off-shore drilling and formed as a ring-like structure with circular inner and outer walls 4, 6 around a central drilling axis D. The inner wall terminates at a deck which comprises a pair of generally rectangular leaves 8 mounted on horizontal slides 8*a* to be movable to expose the open-bottomed space 10 bounded by the inner wall. This enclosed space forms a so-called "moonpool" and it is through the space that the drill string is operated and all the constructional elements of the well are lowered. The space between the inner and outer walls is divided into compartments, which may be separated by vertical partitions, into which items of equipment for the drilling operation can be received and stored, as will be described in more detail below.

Figure 1:
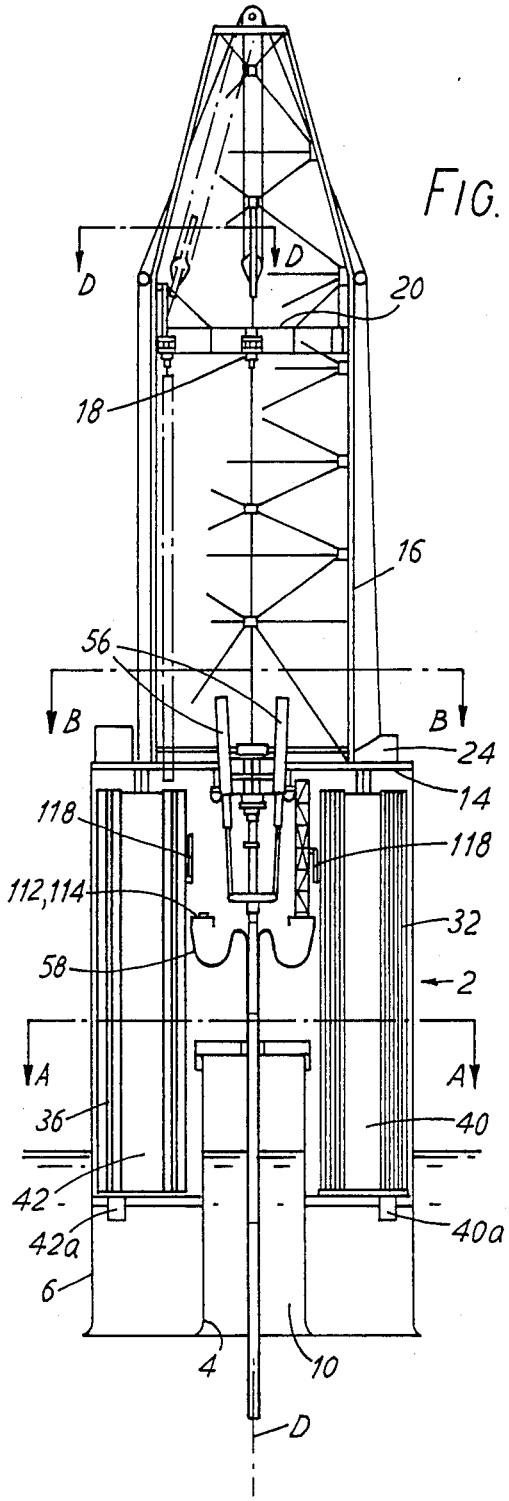
Figure 6:
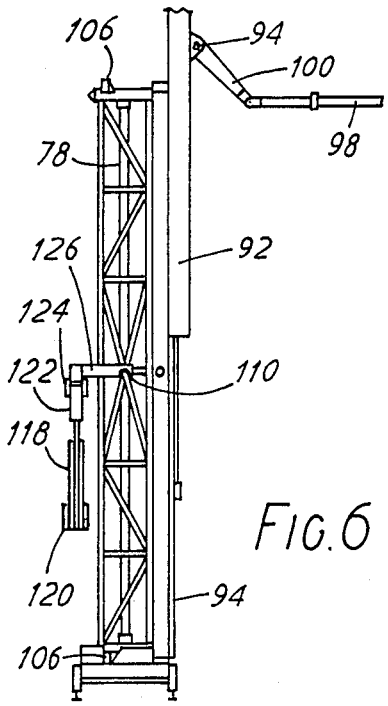

The outer wall 6 is of greater height than the inner wall 4 and it terminates at a main deck 14 from which rises a tower framework 16 carrying lifting gear from which depends a power swivel 18, which may be a hydraulically driven unit of generally known type. The power swivel is mounted on a cross-travel carriage 19 guided on a gantry 20 which is supported at its opposite ends in vertical guides 22 fixed to the framework 16. At least some of the wheels 21 of the carriage 19 are driven by a hydraulic motor to displace the power swivel along the gantry 20. The lifting gear is operated from a hydraulic draw-works 24 and it raises and lowers the power swivel 18 and gantry 20 together, the gantry being restrained in the guides 22. The power swivel is thereby displaceable in a vertical plane containing the drilling axis D. The tower framework 16 is clad over its full extent to form an enclosure 26 (FIG. 3) protecting the working area within it from the weather. In FIG. 1 the power swivel 18 is indicated in its central axial position but it also appears in the figure in an end position on its gantry.

The equipment to be manipulated by the power swivel comprises series of elongate, generally cylindrical drill elements, so-called tubulars of well construction, including drill stands and collars 32 forming the drill string to which the drilling head is attached, and risers 36 forming the outer tube within which the drill string is operated The drill stands and collars 32 are held in one compartment 34 and the risers 36 in a diametrically opposite compartment 38. In each case they are stored with their axes vertical, the shorter riser sections being secured together in pairs that extend the full height of their compartments. In each compartment the tubulars are held in a turntable magazine 40, 42 that is rotatable about a vertical axis.

To assist the handling of tubulars as they are removed from the magazines for use, immediately beneath the main deck there is a rail 44 extending over the magazines and having a guide ring 46 mounted on it through a carriage 47 (FIG. 8). At least some of the rollers 48 of the carriage are driven by a hydraulic motor to move the guide ring along the rail, its centre following a diametrical path that intersects the central drilling axis D, while automatic control means maintain it in vertical alignment with the power swivel 18. The magazines 40, 42 are rotated by respective hydraulic drive motors 40*a*, 42*a* to bring the individual tubulars they carry into vertical alignment with the guide ring 46 and power swivel 18. The lifting hook of the power swivel can therefore be lowered through the guide ring to lift individual tubulars 32, 36 which will still have their lower ends encircled by the guide ring 46 when raised from their magazines. In this state they can be brought to the drilling axis to be assembled into the drill string.

The operation of the power swivel and the guide ring to transfer tubulars to the drilling axis is coordinated by automatic control means, to move the guide ring transversely in step with the power swivel so that the tubulars are maintained vertical throughout, a feature that both reduces the space required and simplifies their handling, while protective pads 52 on the guide ring prevent damage to the tubulars from the ring. The positioning and the appropriate restraint of the tubulars is thereby ensured throughout until they are assembled to the drill string. In all cases pendulation of these long and heavy parts is prevented by the constraint of their lower ends by the guide ring. The assembly of the tubulars 32,36 when they have been brought to the drilling axis, and the drilling operations generally, can be performed in a conventional manner and around the drilling axis there are shown riser tensioners 56 and choke-and-kill lines 58 of known form.

Below the guide ring is a track 62 which supports a cross-carriage 64 in which a slips machine 66 is mounted on rails 68 that allow it to move at right-angles to the track 62. Further rails 70 parallel to the rails 62 are disposed on top of the slips machine for a torque wrench machine 72. The two machines each carry a series, e.g. three, alternative units of different sizes and the slips machine may also have replaceable bushings for handling tubulars of different diameters. The slips units may themselves be of conventional form and are not individually illustrated. The torque wrench units are further described below.

The track 62 allows the machines to be moved clear of the drilling axis when not in use. When brought forward for use, as shown in FIG. 8, movement of the slips machine along the rails 68 brings the required size of unit to the drilling axis. The torque wrench machine also has the appropriate size unit selected by this movement and it can be retracted on its rails 70 while the slips machine is positioned over the drilling axis.

Figure 3:
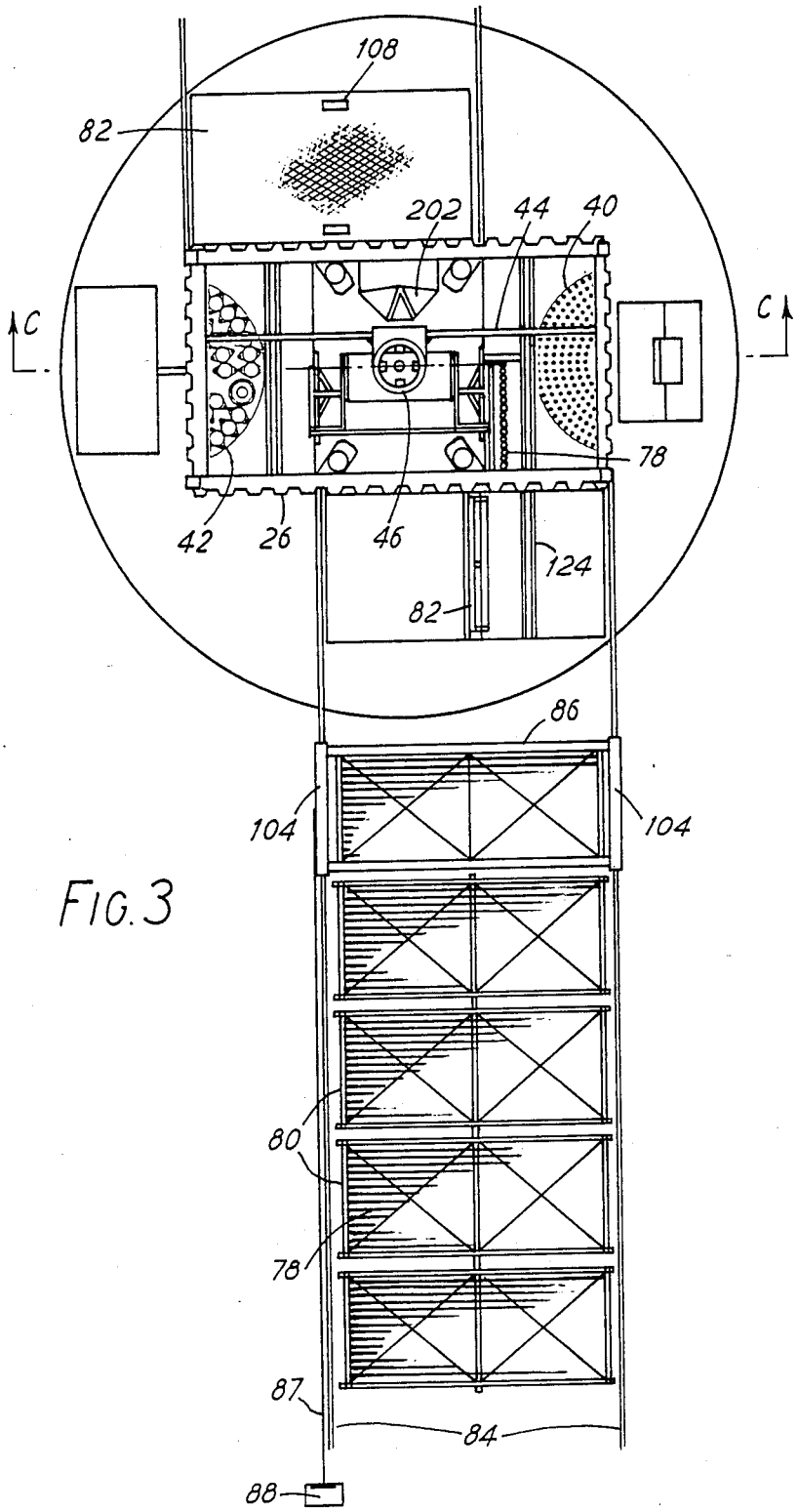
Figure 5:
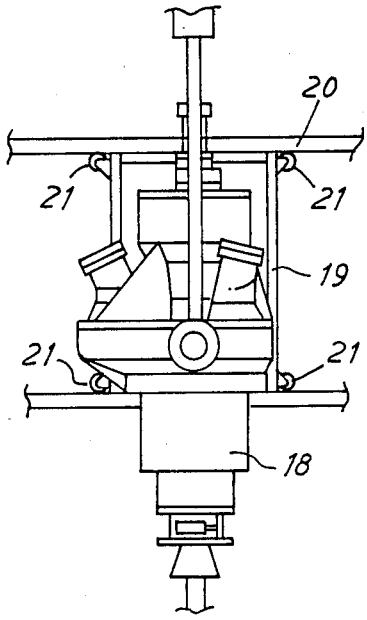
Figure 7:
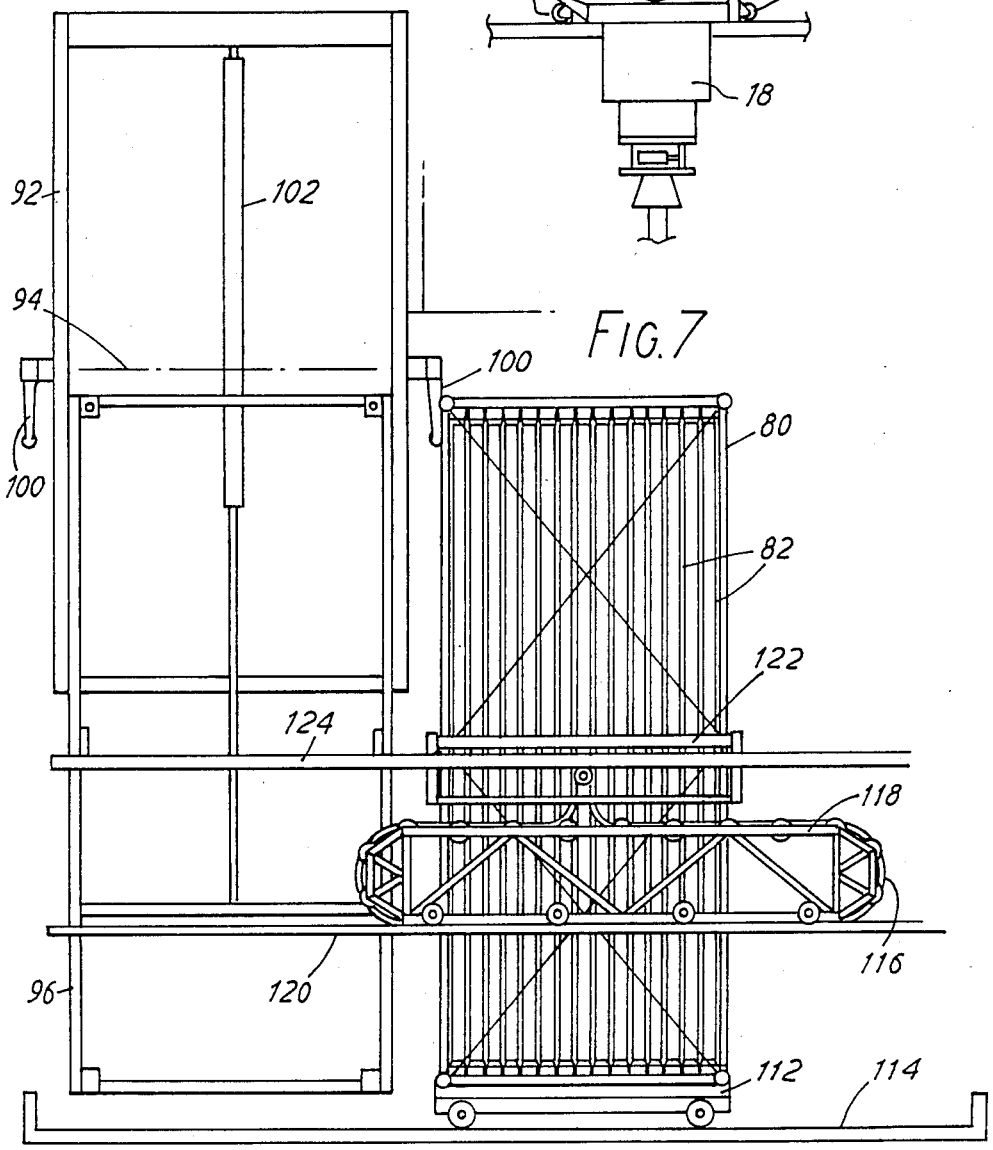

The tubulars handled by the apparatus include casings 78 for lining a drilled hole. These are stored outside the enclosure and are packed and supported in groups in strongbacks 80 i.e. re-usable transport frames. To opposite sides of the enclosure are trap-doors 82 through which the strongbacks are taken into the working area. FIG. 3 shows one door open and one closed, but the two doors 82 and their associated conveying mechanisms, including respective rail tracks 84, are identical and the following description relates to either.

The strongbacks 80 are laid between the rails of a track 84 to be transported to the door 82 by a gantry-form trolley 86 running on the track. The trolleys are driven by hydraulic motors (not shown) supplied by hose lines 87 reeled on a hose winch 88. The door 82 comprises a main frame 92 mounted in the deck 14 on a pivot axis 94 intermediate its length, and a sliding frame 96 movable on the main frame in the plane of the door. The sliding frame is uppermost when the door is flush with the deck. Hydraulic rams 98 pivoted between the door surround and crank 100 fixed to the main frame can swing the door between the horizontal and vertical positions, and a further ram 102 between the main and sliding frames 92,96 can extend the sliding frame.

In the side frames 104 of the trolley 86 are hydraulically rotated screw-jacks (not shown) that engage pads 106 on a strongbacks 80 to lift it and place it on the door 82 while the door is closed and the sliding frame is contracted. The strongback is secured to the sliding frame 92 by hydraulically operated hooks 108 engaging lugs 110 on the strongback, and the door is swung by the rams 98 to the vertical. The ram 102 then extends the sliding frame to lower the vertical casings in their strongback onto a trolley 112 running under the main deck 14 on a track 114 that transverses the path of the common axis of the guide ring 46 and power swivel 18.

A cable handling machine 118, moving on its own track 120, carries hose lines 116 that supply pressure fluid to a hydraulically powered positioner carriage 122 that is displaceable parallel to the trolley track 114 by engagement of driving pinion with a toothed rack on the rails 124. The carriage 122 is provided with pivotable arms 126 at opposite ends that are movable in unison between vertical and horizontal positions by hydraulic actuators (not shown). The arms straddle the width of a strongback 80 and have hooked ends that can drop onto the strongback lugs 110. When the strongback and its casings are loaded onto the trolley, the arms 126 engage the upright strongback and the carriage 122 then steps the strongback along the trolley track 114 to bring its casings 78 successively into register with the axis of the guide ring 46. There the casings can be individually lifted to the drilling axis and lowered into place, using the guide ring 46, in the same manner as the drill string elements.

The trap door 82 is re-closed when the strongback has been positioned under the guide ring. After its casings have been extracted the empty strongback is returned to a storage location on the rail track 84 by a reverse procedure and a further strongback is brought in.

By using the two transfer systems on opposite sides of the drilling axis in alternation, the rate of operation can be increased.

Figure 2:
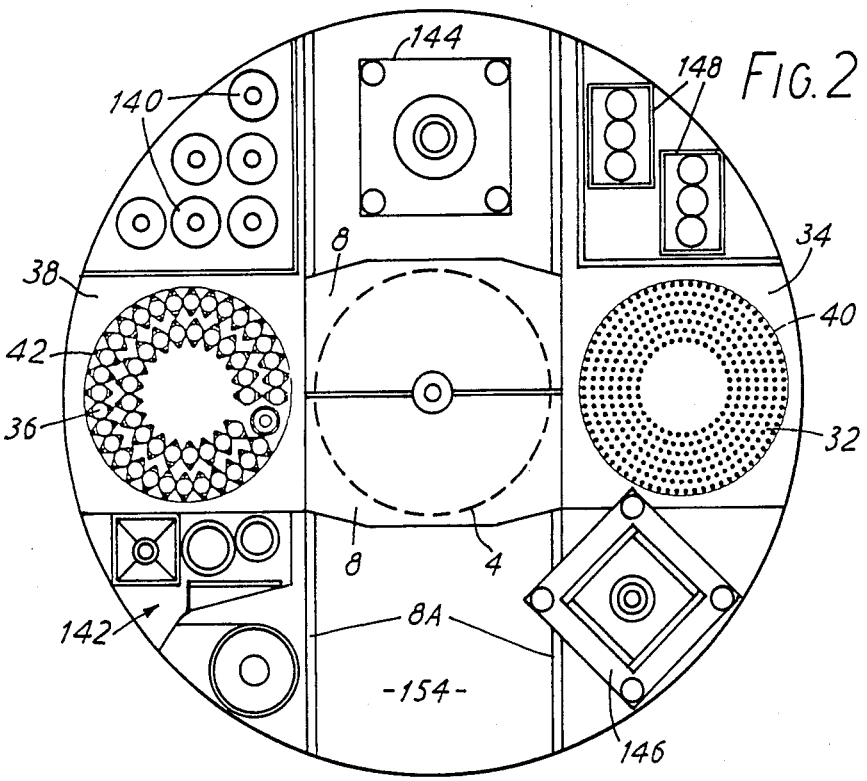
Figure 4:
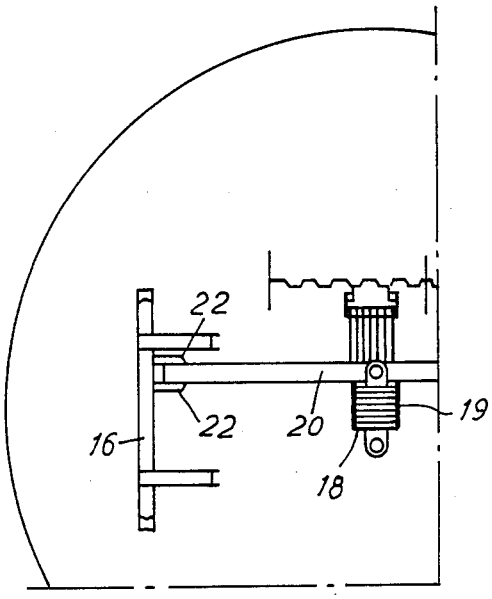

Further elements of the drilling equipment are also stored and are accessible within the compartments that surround the central wall. FIG. 2 indicates such conventional equipment as a blow-out stack preventer 144 and a lower marine riser package 146, which can be assigned to different sections of the annular space between the inner and outer walls of the main body. All the drilling parts can in fact be stored and handled within the one compact unit. Since the apparatus is intended to provide a unit that is self-contained both as regards parts and equipment for the drilling, in other compartments below the main deck are hydraulic power packs 148 with their accumulators by means of which the several drive mechanisms referred to above are powered, gas cylinders 140 for heave compensation accumulators, and mud pumping equipment and cementation plant 142. A further compartment 154 is kept normally clear as a reception area.

Figure 9:
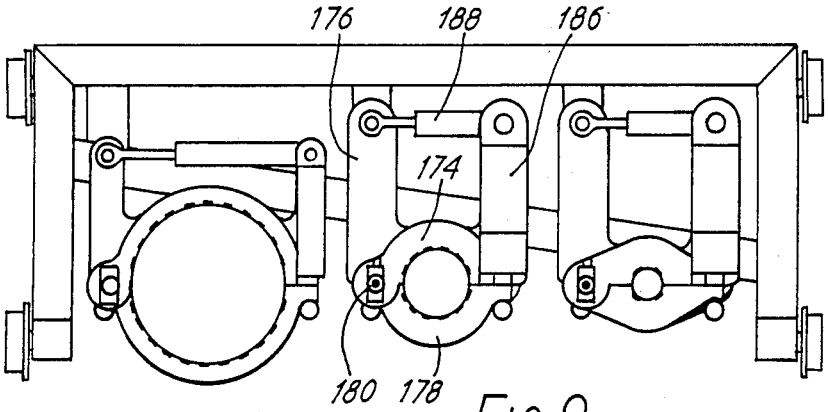
FIGS. 9 and 10 are plan and front elevations of the torque wrench machine.
Figure 10:
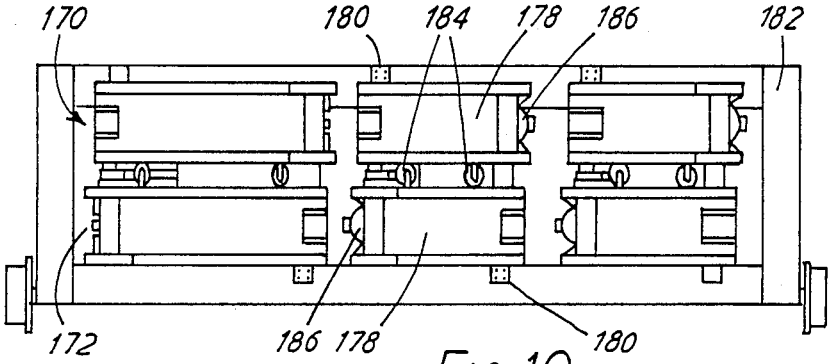

Further details of the torque wrench machine are shown in FIGS. 9 and 10. It has three torque wrench units which have similar mechanisms each comprising upper and lower pairs of jaws 170,172. Each pair of jaws consists of a first jaw 174 integral with a torque arm 176, and a second jaw 178 pivoted on the first jaw by a hydraulic actuator 180 to open and close the jaws. The first jaw of the lower pair 172 is fixed on the machine frame 182 and the upper pair 170 is supported on the lower pair through rollers 184 so as to permit it to rotate coaxially thereon. When closed, the jaws of each pair are clamped together by a hydraulic cylinder 186 mounted on the torque arm 176 and gripping the free end of the second jaw. A further hydraulic cylinder 188 connects the torque arms 176 of the upper and lower pair of jaws and by its displacement the upper pair can be rotated in either direction on the fixed lower pair. A chosen torque wrench unit can be clamped around a drill string at the joint between two drill stands and by coordinated operation of the cylinders 186,188 can screw down or unscrew that joint as required.

Figure 11:
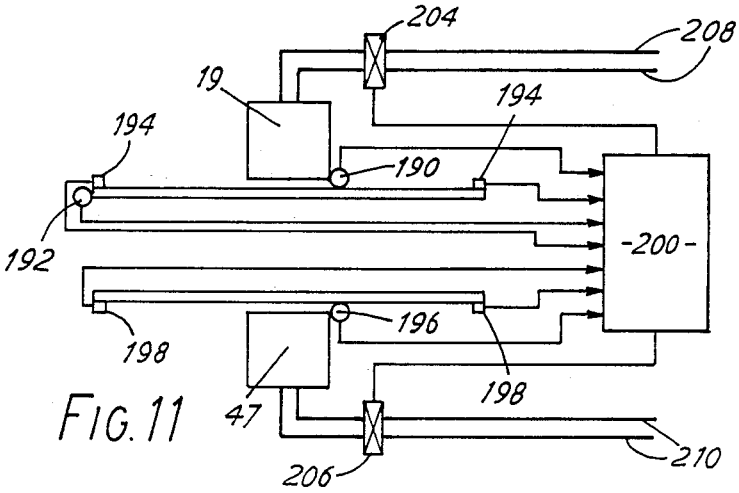
FIG. 11 is a schematic illustration of a part of the automatic control system of the apparatus.

The transfer of the drill elements, risers and casing sections to the drilling axis, and the eventual dismantling of the drill string and riser tube can be carried out by the use of generally known means for automatic control including electronic data processing means for coordinating the various movements to be performed. Since it is possible to employ apparatus and programming methods known to those skilled in the art, a delailed description is not necessary but FIG. 11 indicates in brief outline the apparatus associated with the coordinated displacements of the power swivel and guide ring. Displacement encoders 190,192 are mounted on the power swivel to respond respectively to the horizontal movements of the carriage 19 along the gantry 20 and to the vertical movements of the gantry along the guides 22. Limit switches 194 are shown for the end limits of movement along the gantry and similar limit switches (not shown) may be provided for the vertical movements. Analagously, the guide ring carriage 47 is provided with an encoder 196 and limit switches 198. The encoder and limit switch signals are inputted to a microprocessor 200 in an operation control room 202. The micro-processor receives inputs from the other movement monitoring means that have not been shown and outputs actuating and positioning signals to the various drive means, including those on the magazines 40,42, the slips machine 66, the torque wrench machine 72, the trolleys 86 and the carriages 122, in accordance with a programmed sequence under the supervision of the operator in the control room 202 overseeing the operation of the apparatus. In the case of the power swivel and the guide ring, the actuating signals are transmitted to solenoid-operated valves 204,206 in the hydraulic lines 208,210 of the motors of the carriages 19,47 respectively so as to maintain the power swivel and guide ring in vertical alignment when the carriages are moved, so that each tubular and casing section is confined to a vertical orientation while being transferred to and from the drilling axis.

The apparatus can be deployed in a number of ways for underwater drilling and as examples are shown a semisubmersible rig (FIG. 12) and a jack-up rig (FIG. 13). In practice, the apparatus can be constructed as an integral part of such a rig but it will generally be preferred to make it a separate unit that can be reused in another rig. The apparatus could be constructed at a shore site complete with such parts as the tubulars in their magazines, as well as the other components held in the compartments around the moonpool. At the end of drilling operations it would be returned to a shore site for re-equipment with consumable parts such as the tubulars before being mounted in a fresh rig as required.

I claim:

1. Apparatus for handling elongate drill string elements that are to be assembled together on a drilling axis for use in a well-forming operation, the apparatus comprising:

lifting means for transferring said elements to a position on the drilling axis for said assembly, at least one storage space laterally offset from the drilling axis, a magazine in said storage space for holding the elements with their axes substantially vertical, mounting means for said magazine defining a rotary axis substantially parallel to the drill string elements therein, lifting means for raising an element from said storage space, means for moving said lifting means transversely to the drilling axis to transfer the element from said storage space to the drilling axis, guide means engagable with the raised element, means for moving the guide means on a parallel path to and in step with the lifting means for restraining the raised element so as to prevent or limit swinging of the element on said lifting means while it is being moved to the drilling axis, and drive means for displacing the magazine about said rotary axis to bring successive elements to a zone of action of the guide means when they are to be withdrawn from the storage space.

2. Apparatus according to claim 1 wherein a magazine is provided in said storage space to hold the individual elongate elements, and drive means are provided to displace the magazine to bring successive elements to a zone of action of the guide means when they are to be withdrawn from the storage space.

3. Apparatus according to claim 2 wherein the magazine has mounting means on which it is rotatable about an axis substantially parallel to the elements therein, and said drive means displace the magazine about said axis.

4. Apparatus according to claim 1 wherein the guide means comprises a device that is displaceable to and from the drilling axis at a level above said storage space such that when an element is raised by the lifting means to be moved to the drilling axis, its lower end is engaged by the guide device.

5. Apparatus according to claim 4 wherein the guide device comprise a ring guide through which the drill string elements are lifted when removed from the storage space.

6. Apparatus according to claim 1 comprising a plurality of said storage spaces at locations angularly spaced about the drilling axis, said guide means being provided for engaging the elements held in each of said spaces as they are moved to the drilling axis.

7. Apparatus according to claim 6 wherein a common guide means is movable to opposite sides of the drilling axis to be positioned over respective storage spaces holding drill string elements at the opposite sides of the axis.

8. Apparatus according to claim 1 wherein said at least one storage space is provided in a structure enclosing a central opening through which the drilling axis passes, and carrier means on which the lifting means and guide means are movable are supported on said structure to extend transversely across said central opening.

9. Apparatus according to claim 1 further comprising means for handling bore-hole casings to present said casings in a substantially vertical orientation to the lifting means, for transfer of the casings to the drilling axis by use of said lifting means and guide means.

10. Apparatus according to claim 9 wherein said casings are arranged to be stored with their axes substantially horizontal and means are provided for tilting them to the upright state and for transferring them in that state to a carrier at a lower level than the lifting and guide means, a guide track being provided along which said carrier is displaceable along a path transverse to the direction of movement of the lifting means and guide means, whereby the casings are held with their axes substantially vertical and brought successively by the displacement of the carrier into a zone of action of the guide means and lifting means to be successively conveyed to the drilling axis.

11. Apparatus for handling off-shore drilling equipment comprising a structure forming a ring-like enclosure, a central open-bottomed space being surrounded and protected by said enclosure and providing a free air/water surface, means above said space for suspending and operating a drill string whereby a drilling axis extends downwardly through said space into the water, and means for supplying drilling elements and bore-hole casing elements from storage locations in the structure for said element to be assembled on the drilling axis, in the space protected by said structure.

12. Apparatus according to claim 11 wherein a mounting for said means for suspending and operating a drill string is disposed over the central space and storage locations for the elements are located on the structure offset from said central space, said suspending and operating means being displaceable on said mounting transversely of the drilling axis to and from said storage locations, and an enclosure around said mounting also enclosing said central space.

13. Apparatus for handling elongate drill string elements that are to be assembled together on a drilling axis for use in a well-forming operation, the apparatus comprising:

lifting means comprising a lifting device, transfer means for transferring said elements to a position on the drilling axis for the assembly of said elements to be performed, at least one storage space laterally offset from the drilling axis and holding the elements with their axes substantially vertical, lifting means for raising the elements from said storage space, means for moving said lifting means transversely to the drilling axis to transfer the elements in their substantially vertical orientation from said storage space to the drilling axis, guide means for maintaining said orientation of each raised element, said guide means comprising a member for surrounding a lower region of the raised element, and means for supporting the guide means at a level above said storage space and for moving the guide means at said level along a path parallel to and in step with the lifting means for restraining the raised element so as to prevent or limit swinging of the element on sai lifting means while it is being displaced towards and away from the drilling axis.

14. Apparatus for handling elongate drill string elements and bore-hole casings that are to be assembled together on a drilling axis for use in a well-forming operation, the apparatus comprising:

lifting means for transferring said drill string elements and casings to a position on the drilling axis for said assembly, at least one storage space laterally offset from the drilling axis and holding the drill string elements with their axes substantially vertical, lifting means for raising said elements from said storage space, means for moving said lifting means along a path transverse to the drilling axis to transfer the elements in their substantially vertical orientation from said storage space to the drilling axis, guide means engagable with each raised element, means for moving the guide means on a parallel path to and in step with the lifting means for restraining the raised element so as to prevent or limit swinging of the element on said lifting means while it is being moved to the drilling axis, and means for transporting the bore-hole casings with their axes substantially vertical along a path offset from the drilling axis and transverse to said lifting means path for lcoating the individual casings underneath the lifting means for them to be transferred to the drilling axis by the use of said lifting means and guide means.

* * * * *